US010727565B2

(12) United States Patent
Kim et al.

(10) Patent No.: US 10,727,565 B2
(45) Date of Patent: Jul. 28, 2020

(54) APPARATUS FOR MULTIPLE RESONANCE ANTENNA

(71) Applicants: Samsung Electronics Co., Ltd., Suwon-si, Gyeonggi-do (KR); Korea University Research and Business Foundation, Seoul (KR)

(72) Inventors: Moonil Kim, Seongnam-si (KR); Kyoung Min Lee, Seoul (KR); Seung Ho Choi, Seoul (KR)

(73) Assignees: Samsung Electronics Co., Ltd., Suwon-si (KR); Korea University Research and Business Foundation, Seoul (KR)

( * ) Notice: Subject to any disclaimer, the term of this patent is extended or adjusted under 35 U.S.C. 154(b) by 134 days.

(21) Appl. No.: 15/380,326

(22) Filed: Dec. 15, 2016

(65) Prior Publication Data

US 2017/0179569 A1 Jun. 22, 2017

(30) Foreign Application Priority Data

Dec. 16, 2015 (KR) ..... 10-2015-0180220

(51) Int. Cl.

| | |
|---|---|
| ***H01Q 13/18*** | (2006.01) |
| ***H01Q 5/342*** | (2015.01) |
| ***H01Q 5/25*** | (2015.01) |
| ***H01Q 1/38*** | (2006.01) |
| ***H01Q 9/04*** | (2006.01) |
| ***H01Q 1/22*** | (2006.01) |
| *H01P 7/06* | (2006.01) |

(52) U.S. Cl.
CPC ..... *H01Q 1/2283* (2013.01); *H01Q 1/38* (2013.01); *H01Q 5/25* (2015.01); *H01Q 5/342* (2015.01); *H01Q 13/18* (2013.01); *H01P 7/065* (2013.01); *H01Q 9/0485* (2013.01)

(58) Field of Classification Search
CPC .... H01Q 9/0485; H01Q 13/18; H01Q 9/0407; H01Q 13/10; H01Q 13/106; H01P 7/065
See application file for complete search history.

(56) References Cited

U.S. PATENT DOCUMENTS 6,535,085 B2 * 3/2003 Song ..... H01P 7/065 333/219
2006/0017571 A1 * 1/2006 Arnold ..... G06K 19/07749 340/572.7

(Continued)

FOREIGN PATENT DOCUMENTS

| | | |
|---|---|---|
| KR | 10-1067118 B1 | 9/2011 |
| KR | 10-1119267 B1 | 3/2012 |
| KR | 10-1119354 B1 | 3/2012 |

*Primary Examiner* — Ricardo I Magallanes
(74) *Attorney, Agent, or Firm* — Jefferson IP Law, LLP

(57) ABSTRACT

An apparatus of an antenna is provided. The apparatus includes a first conductor plate disposed on an upper side of a single plate and comprising an aperture, a plurality of vias inserted to vertically penetrate through the single plate, a second conductor plate disposed on a lower side of the single plate, and a feed line for applying a signal to radiate to a dielectric resonator embedded as a cavity which is formed by the first conductor plate, the second conductor plate, and the vias. The aperture is in a size which produces multiple-resonance at an operating frequency.

15 Claims, 13 Drawing Sheets

(56) References Cited

U.S. PATENT DOCUMENTS

| | | | | |
|---|---|---|---|---|
| 2008/0238793 | A1* | 10/2008 | Channabasappa ... | H01Q 9/0457 343/767 |
| 2011/0133991 | A1 | 6/2011 | Lee et al. | |
| 2011/0248890 | A1 | 10/2011 | Lee et al. | |
| 2011/0248891 | A1 | 10/2011 | Han et al. | |
| 2015/0207233 | A1* | 7/2015 | Kim ..... | H01Q 9/0485 343/785 |
| 2016/0301129 | A1* | 10/2016 | Ying ..... | H01Q 1/523 |

* cited by examiner

APPARATUS FOR MULTIPLE RESONANCE ANTENNA

CROSS-REFERENCE TO RELATED APPLICATION(S)

This application claims the benefit under 35 U.S.C. § 119(a) of a Korean patent application filed on Dec. 16, 2015 in the Korean Intellectual Property Office and assigned Serial number 10-2015-0180220, the entire disclosure of which is hereby incorporated by reference.

JOINT RESEARCH AGREEMENT

The present disclosure was made by or on behalf of the below listed parties to a joint research agreement. The joint research agreement was in effect on or before the date the present disclosure was made and the present disclosure was made as a result of activities undertaken within the scope of the joint research agreement. The parties to the joint research agreement are 1) Samsung Electronics Co., Ltd. and 2) Korea University Research and Business Foundation.

TECHNICAL FIELD

The present disclosure relates to an antenna apparatus having multiple-resonances.

BACKGROUND

As a transmitting/receiving system of the related art, products configured by assembling separate parts have been mainly used. However, recent studies have been conducted on system on package (SOP) products which configure the transmitting/receiving system of a millimeter wave band in a single package, and some products are commercialized. A technology for providing the single package product has been developed together with a multi-layer substrate process technology which stacks a dielectric substrate, such as low temperature co-fired ceramic (LTCC) and liquid crystal polymer (LCP).

In an environment, such as the LTCC process and the LCP process, a patch antenna having a planar characteristic is mainly used. The patch antenna is disadvantageous in that its bandwidth generally narrows below 5%. To address the narrow bandwidth, the bandwidth is expanded by generating multiple-resonances by adding a parasitic patch on the same plane as the patch antenna serving as a main radiator, or by inducing multiple-resonances by stacking two or more patch antennas.

The bandwidth can increase using a plurality of patches. However, using such a multiple-resonance technology, a radiation pattern of the antenna may be different for each resonant frequency and the antenna characteristic due to process errors may change more considerably than the single resonance antenna. Hence, in order to increase efficiency and to secure a wider bandwidth of the antenna, a dielectric resonator antenna (DRA) may be used. It is known that the DRA has excellent characteristics in terms of the bandwidth and the efficiency, compared with the patch antenna of the related art having the multiple-resonances.

Although the DRA is frequently used in order to overcome drawbacks of the patch antenna, it requires a separate dielectric resonator outside of a substrate. As a result, it is more difficult to manufacture the DRA than the patch antenna which is fabricated through the single process. In addition, the DRA can generate the multiple-resonance in response to the size increase of the dielectric resonator (e.g., a length in a direction not affecting the resonant frequency) and thus secure a wider bandwidth, but is disadvantageous in that its radiation pattern is skewed within the bandwidth.

Therefore, a need exists for an antenna apparatus having multiple-resonances.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure to provide an antenna apparatus having multiple-resonances.

Another aspect of the present disclosure is to provide a cavity antenna apparatus enabling multiple-resonance.

Another aspect of the present disclosure is to provide a cavity antenna apparatus configured on a single substrate.

In accordance with an aspect of the present disclosure, an apparatus of an antenna is provided. The apparatus includes a first conductor plate disposed on an upper side of a single plate and comprising an aperture, a plurality of vias inserted to vertically penetrate through the single plate, a second conductor plate disposed on a lower side of the single plate, and a feed line for applying a signal to radiate to a dielectric resonator embedded as a cavity which is formed by the first conductor plate, the second conductor plate, and the vias. The aperture is in a size which produces multiple-resonance at an operating frequency.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components and structures.

DETAILED DESCRIPTION

Figure 1:
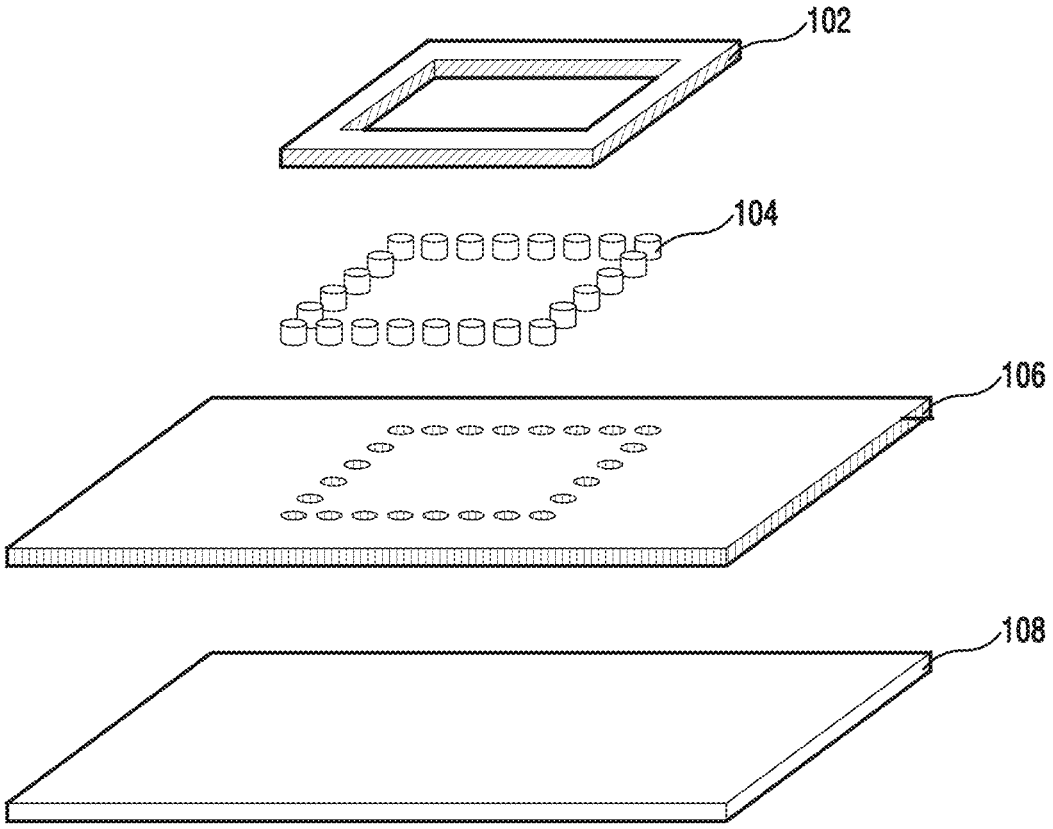
FIG. 1 depicts an antenna apparatus according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Various embodiments of the present disclosure provide an antenna structure for radiating a signal. More specifically, various embodiments of the present disclosure provide an antenna, as a cavity antenna, having a multiple-resonance characteristic.

Hereinafter, terms indicating components of an antenna or a structure assembled with the antenna, terms indicating operation states of the antenna, and terms for measurement of the antenna are defined to ease the understanding. Accordingly, the present disclosure is not limited to those terms and can adopt other terms having technically equivalent meanings.

An antenna apparatus according to various embodiments has a cavity antenna structure. The cavity antenna radiates a signal by feeding the signal into a space surrounded by a conductor including one open side and resonating the signal in the space. The open side is referred to as an aperture.

An antenna apparatus according to various embodiments can be mounted on a substrate. Hence, conductors for surrounding a space can be disposed on or inside a substrate in various forms. For example, the antenna can be implemented using a metal plate or vias as shown in FIG. 1.

Various embodiments can be applied to radiate a signal of, but not limited to, a terahertz band. Typically, the terahertz indicates frequencies ranging from about 300 GHz to 3000 GHz or from 100 GHz to 3000 GHz. A signal of other frequency band can be radiated according to various embodiments to be explained.

FIG. 1 depicts an antenna apparatus according to an embodiment of the present disclosure.

Referring to FIG. 1, the antenna apparatus includes a first conductor plate 102, a via set 104, a substrate 106, and a second conductor plate 108. The components of FIG. 1 are explained for a structure of the antenna apparatus but are not depicted based on their size in a particular design.

The first conductor plate 102 can be formed with a metal and includes an aperture. The first conductor plate 102 is disposed on the via set 104 and the substrate 106. Accordingly, the first conductor plate 102 forms a top side of the antenna apparatus and the aperture.

The via set 104 includes a plurality of vias, and each via can include a conductor. The via set 104 can build sides of the antenna apparatus. For example, the vias of the via set 104 are arranged along edges of the aperture and build a via fence. The vias of the via set 104 can be arranged at certain intervals. The interval between the vias can be designed as small as possible within an allowable range of a semiconductor process. In FIG. 1, each via in the via set 104 is formed in a cylindrical shape including the same top and bottom cross sections. According to various embodiments of the present disclosure, each via can be formed in a polygonal shape, and its top and bottom cross sections can have different shapes.

The substrate 106 is a structure for mounting an integrated circuit for the antenna apparatus according to various embodiments of the present disclosure. The substrate 106 includes via holes for receiving the via set 104. The substrate 106 is a single substrate. The substrate 106 interconnects the first conductor plate 102, the via set 104, and the second conductor plate 108. Although the substrate 106 is the single plate, it can have a multi-layer structure for mounting at least one pattern and a feed line.

The second conductor plate 108 can be formed with a metal and forms a bottom side of the antenna apparatus. The second conductor plate 108 is disposed below the substrate 106. For example, the second conductor plate 108 is disposed opposite to the first conductor plate 102 based on the substrate 106.

Although not depicted in FIG. 1, the antenna apparatus can further include a feed line for providing a signal to radiate. A position of the feed line can vary according to embodiments of the present disclosure. For example, the feed line can be disposed above the first conductor plate 102, or in the middle of the substrate 106. For example, the feed line can be disposed between inner layers of the substrate 106, or above the first conductor plate 102.

For example, the antenna apparatus according to an embodiment includes the first conductor plate 102 disposed on the top side of the substrate 106 and including the aperture, the via set 104 including the vias inserted to vertically penetrate through the substrate 106, and the second conductor plate 108 disposed below the substrate 106. The antenna apparatus can further include the feed line which applies the signal to radiate to a dielectric resonator embedded in a cavity formed by the first conductor plate 102, the second conductor plate 108, and the via set 104. Herein, the aperture is designed in a size to produce multiple-resonance at an operating frequency.

Figure 2:
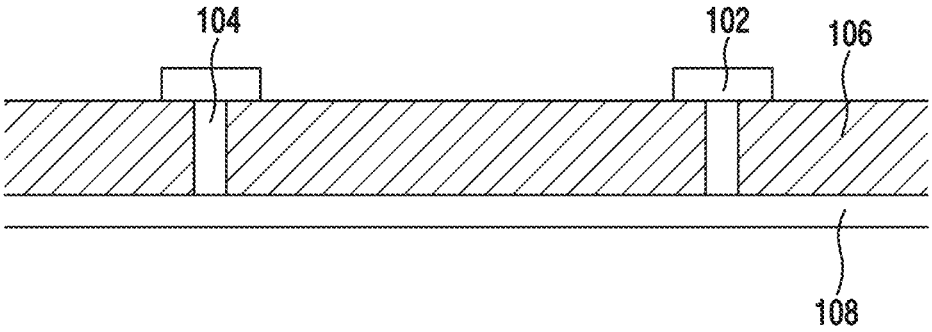
FIG. 2 depicts a cross-sectional view of an antenna apparatus according to an embodiment of the present disclosure.

FIG. 2 depicts a cross-sectional view of an antenna apparatus according to an embodiment of the present disclosure.

Referring to FIG. 2, the cross-sectional view of the antenna apparatus including the components of FIG. 1 is illustrated. The via set 104 is inserted into the substrate 106. The first conductor plate 102 is mounted on the substrate 106 and the second conductor plate 108 is mounted below the substrate 106.

In FIG. 2, the first conductor plate 102 is mounted onto the substrate 106. According to another embodiment of the present disclosure, the substrate 106 may include a groove on an upper portion, for inserting the first conductor plate 102 down to a certain depth, and the first conductor plate 102 can be inserted into the substrate 106.

Figure 3:
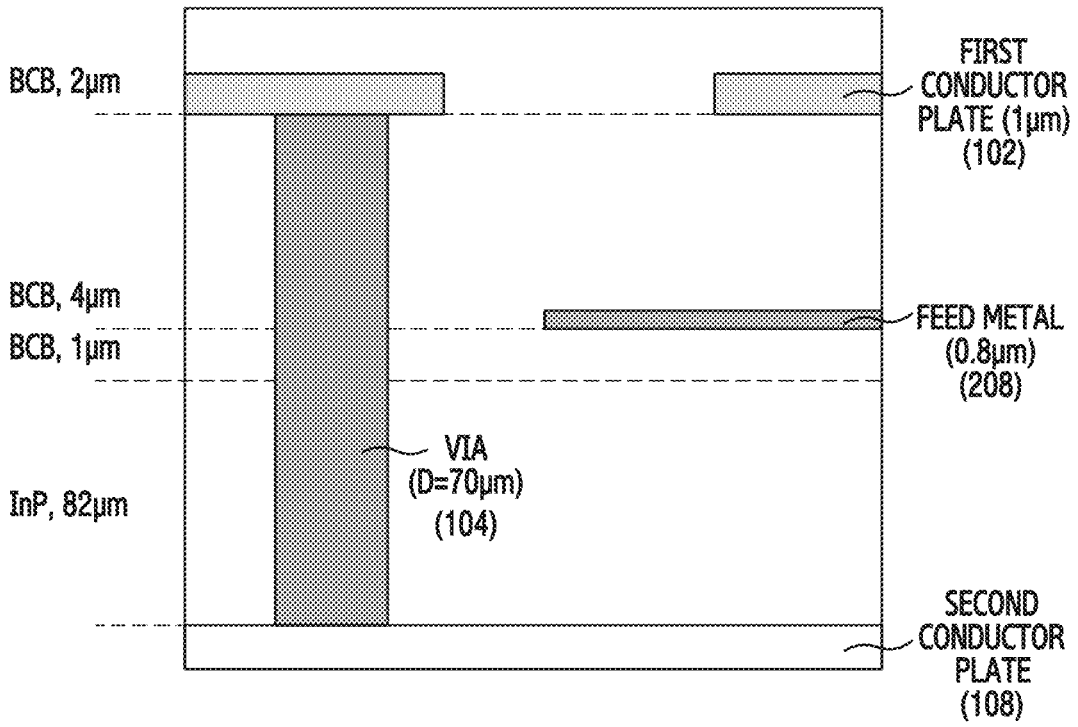
FIG. 3 depicts an antenna apparatus according to an embodiment of the present disclosure.

FIG. 3 depicts an antenna apparatus according to an embodiment of the present disclosure.

Referring to FIG. 3, a cross-sectional view of the antenna apparatus on a multi-layer substrate is illustrated. The substrate includes a plurality of layers. In FIG. 3, four layers can include a first layer formed with indium phosphide (InP), a second layer formed with benzocyclobutene (BCB), a third layer formed with BCB, and a fourth layer formed with BCB. Herein, the first layer can be designed in a thickness of 82 μm, the second layer can be designed in the thickness of 1 μm, the third layer can be designed in the thickness of 4 μm, and the fourth layer can be designed in the thickness of 2 μm. Each layer can be present for a metal line which is referred to as an interconnect layer. For example, since low-permittivity insulating layers formed with a material, such as $SiO_2$, InP, BCB are thin, three or four layers enabling metal patterning can be provided. Although the feed line (e.g., a feed metal 208) and the aperture are formed on a surface layer built by the insulating layers, the cavity antenna can operate normally in the terahertz band. Herein, the multi-layer configuration is not notably relevant to the cavity antenna formation.

The second conductor plate 108 is disposed on a lower surface of the substrate, and the first conductor plate 102 for forming the aperture is disposed on an upper surface of the substrate. The first conductor plate 102 and the second conductor plate 108 are electrically connected by the via set 104. Herein, the first conductor plate 102 can be designed in the thickness of 1 μm and the via set 104 can be designed in the thickness of 70 μm. A feed metal 208 can be inserted into the substrate. For example, the feed metal 208 can be disposed on the second layer. For example, a feed antenna, that is, the feed metal 208 can be disposed on a surface layer close to the aperture, not inside the cavity. Herein, the thickness of the feed metal 208 can be 0.8 μm.

Figure 4:
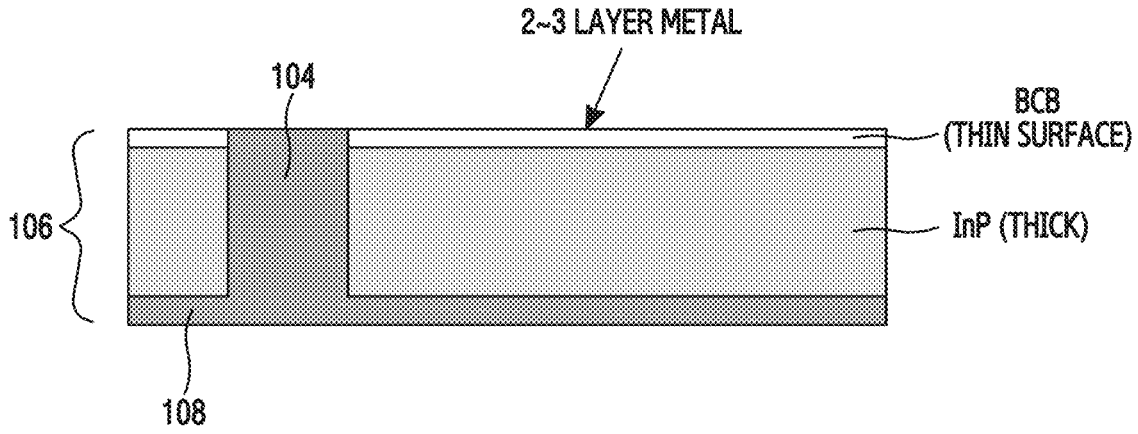
FIG. 4 depicts a substrate for an antenna apparatus according to an embodiment of the present disclosure.

FIG. 4 depicts a substrate for an antenna apparatus according to an embodiment of the present disclosure.

Referring to FIG. 4, the antenna apparatus according to an embodiment includes a substrate 106, the via set 104, and the second conductor plate 108. Herein, the substrate 106 has a vertical layer structure of a single substrate. Notably, the substrate 106 can include a plurality of layers, and the single substrate can include a thick layer formed with InP and a thin surface formed with BCB as shown in FIG. 4. Hence, two- or three-layer metal patterning is feasible. The two- or three-layer metal patterning is for a general semiconductor circuit configuration and is not greatly relevant to the cavity antenna apparatus formation according to various embodiments of the present disclosure.

For example, the antenna apparatus according to an embodiment has a single semiconductor structure, rather than a stack structure. Hence, the antenna apparatus can be fabricated in an integrated circuit process. More specifically, the first conductor plate 102, the vias 104, and the second conductor plate 108 can be combined to the substrate 106 through the semiconductor manufacturing process. For example, the semiconductor manufacturing process can implement the antenna apparatus of the cavity structure according to various embodiments of the present disclosure. Specifically, the antenna apparatus can be implemented with merely one substrate of a certain thickness by forming the cavity using the plurality of the vias, without the metal patterning. For example, the aforementioned structure can fabricate the antenna apparatus having high efficiency and broadband characteristic without additional manufacturing or assembling.

The antenna has a resonance mode according to a signal frequency. When a signal of the resonant frequency is supplied, radio radiation is facilitated and the antenna radiates the signal. In case of the cavity antenna, the antenna performance, such as operating frequency, bandwidth, and efficiency can be optimized according to the cavity size. For example, a frequency which generates the resonance mode can differ according to a cavity depth. The antenna apparatus according to various embodiments needs to obtain the minimum cavity depth in order to generate a particular resonance mode at a particular frequency. However, when the cavity is too deep, multiple resonance modes occur at an adjacent frequency. In this regard, it is necessary to achieve an appropriate depth of the cavity. In the antenna apparatus according to various embodiments of the present disclosure, the cavity is formed by the via fence and accordingly the via length, that is, the cavity depth differs according to the thickness of the substrate. Thus, characteristics of FIG. 5 can be considered to determine the substrate thickness required for the multiple-resonance.

Figure 5:
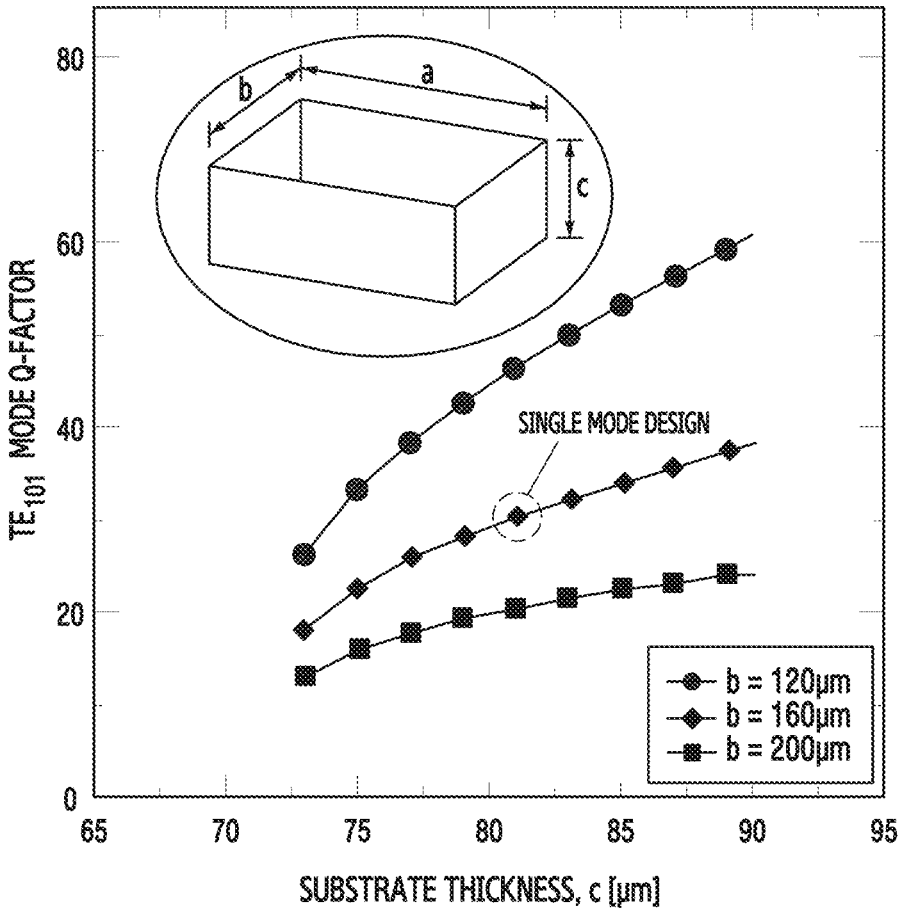
FIG. 5 depicts a Q-factor of an antenna apparatus according to an embodiment of the present disclosure.

FIG. 5 depicts a Q-factor of an antenna apparatus according to an embodiment of the present disclosure.

Referring to FIG. 5, the Q-factor of a Transverse Electric 101 ($TE_{101}$) mode is illustrated, which varies according to the substrate thickness. The TE mode indicates that a magnetic field component exists in a propagation direction of electromagnetic waves along a transmission line, and a transverse wave without the magnetic field component is formed. The $TE_{101}$ mode of TE modes is a resonance mode occurring mostly at the lowest frequency. The Q-factor is an index of resonance sharpness.

FIG. 5 shows Q-factor change predicted based on the substrate thickness, that is, the thickness c of the cavity antenna when an aperture height b of the cavity antenna is 120 μm, 160 μm, and 200 μm. Referring to FIG. 5, the substrate thickness required to generate the $TE_{101}$ mode at 300 GHz is at least 70 μm. For example, when the substrate thickness is too small, the resonance inside the cavity is generated at a higher frequency than 300 GHz. Hence, to support the resonance at 300 GHz, it is advantageous that the thickness exceeds 70 μm over ¼ wavelength. By contrast, when the substrate is too thick, for example, when the substrate thickness at 300 GHz exceeds 90 μm, the increase of the resonance can reduce the bandwidth.

When the aperture size of the cavity is increased, the bandwidth can be increased. This is because the resonant frequency of another resonance mode $TM_{111}$ is included in the bandwidth and thus double resonance occurs. Hence, to tune the resonant frequency, it is advantageous to fix the width of the aperture of the cavity to about 400 μm at 300 GHz.

Meanwhile, as the aperture height b of the cavity increases, the bandwidth characteristic can enhance regardless of the resonant frequency of the $TE_{101}$ mode. However, when the aperture height b exceeds 300 μm, multiple modes can concurrently occur in a frequency band near 300 GHz. Thus, the multi-mode resonance can attain a wide frequency band. Yet, the multiple-resonance can exhibit the antenna characteristic, such as radiation pattern change, but it does not greatly matter to the signal delivery performance in a communication environment under severe scattering.

Figure 6:
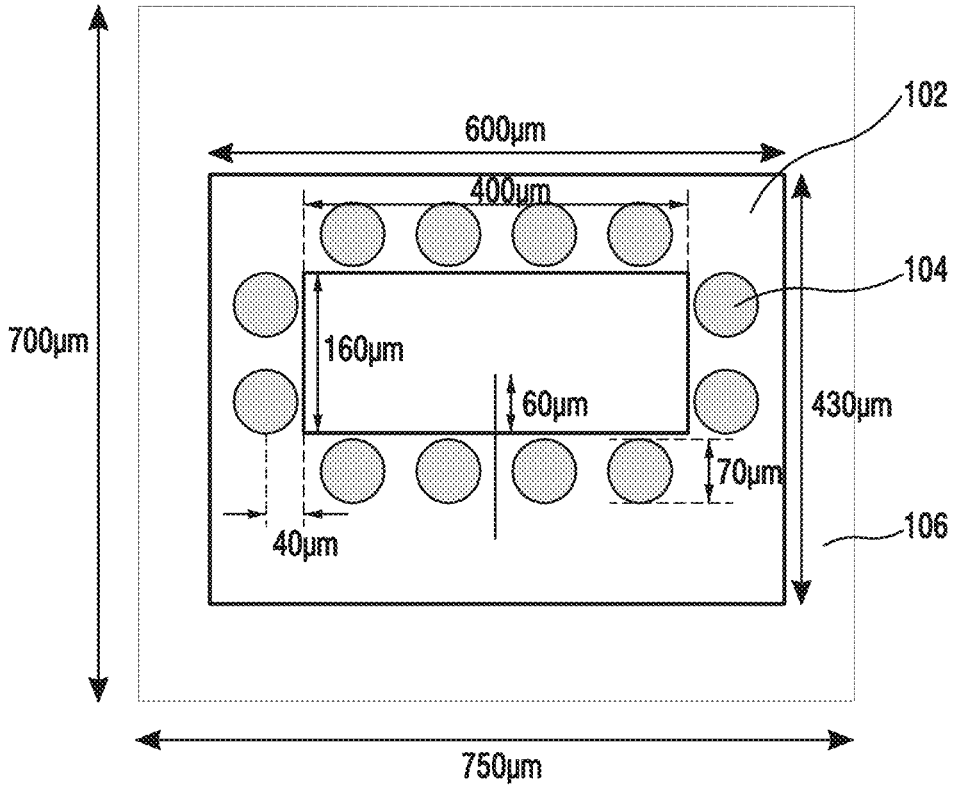
FIG. 6 depicts a design of an antenna apparatus having a single-resonance characteristic according to an embodiment of the present disclosure.

FIGS. 6, 7, 8A, and 8B depict designs and characteristics of an antenna which generates a single resonance according to various embodiments of the present disclosure. FIG. 6 depicts a design of an antenna apparatus having a single-resonance characteristic.

Referring to FIG. 6, the first conductor plate 102 is 600×430 μm and the aperture in the first conductor plate 102 is 400×160 μm in size. For example, the height of the aperture is 160 μm and its width is 400 μm. A diameter of the via set 104 is 70 μm, and a distance from a boundary of the aperture to the center of the via set 104 is 40 μm. The feed line protrudes 60 μm toward the aperture. At this time, the resonant frequency is shown in FIG. 7.

Figure 7:
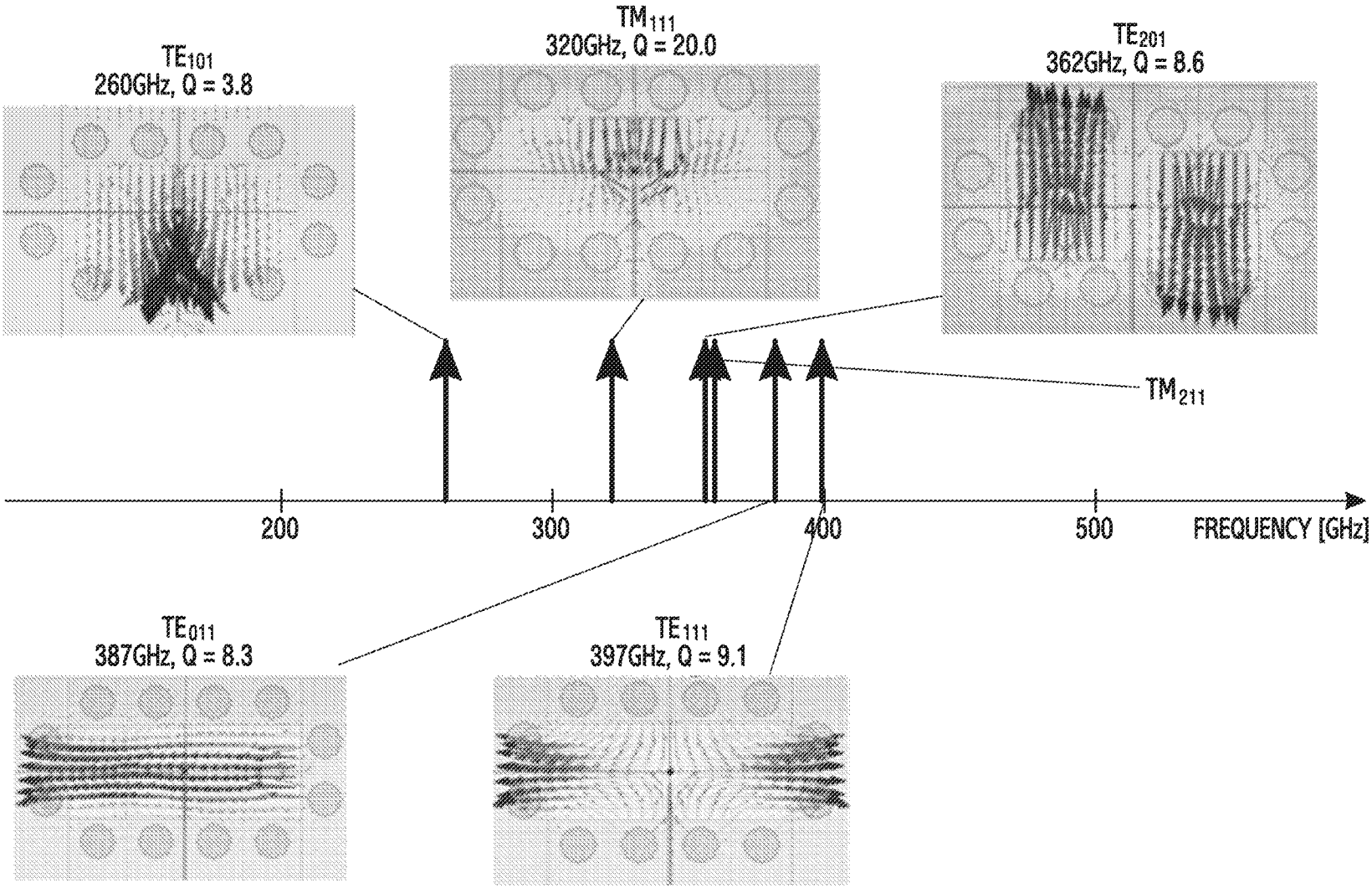
FIG. 7 depicts resonant frequencies of an antenna apparatus having a single-resonance characteristic according to an embodiment of the present disclosure.

FIG. 7 depicts resonant frequencies of an antenna apparatus having a single resonance characteristic resonance according to an embodiment of the present disclosure.

Figure 8A:
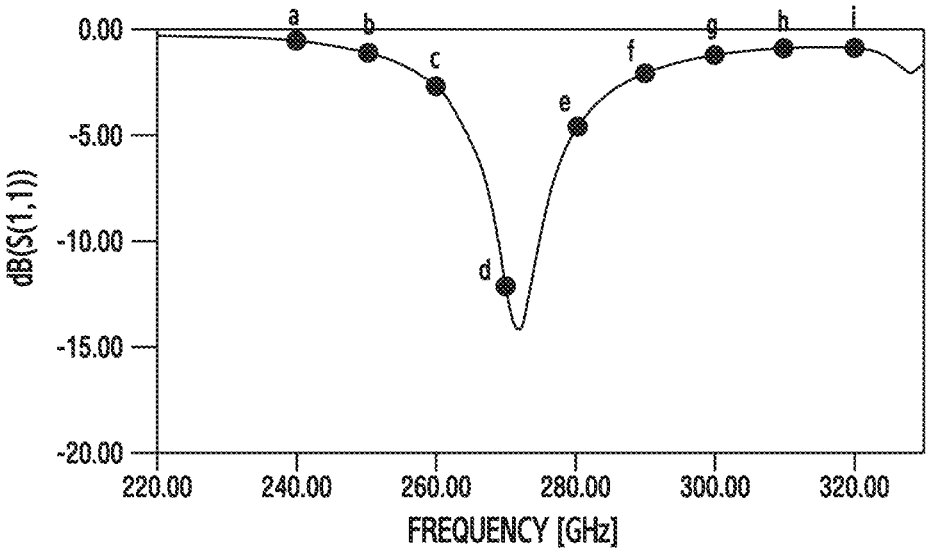
FIGS. 8A and 8B depict radiation patterns of an antenna apparatus having a single-resonance characteristic according to various embodiments of the present disclosure.
Figure 8B:
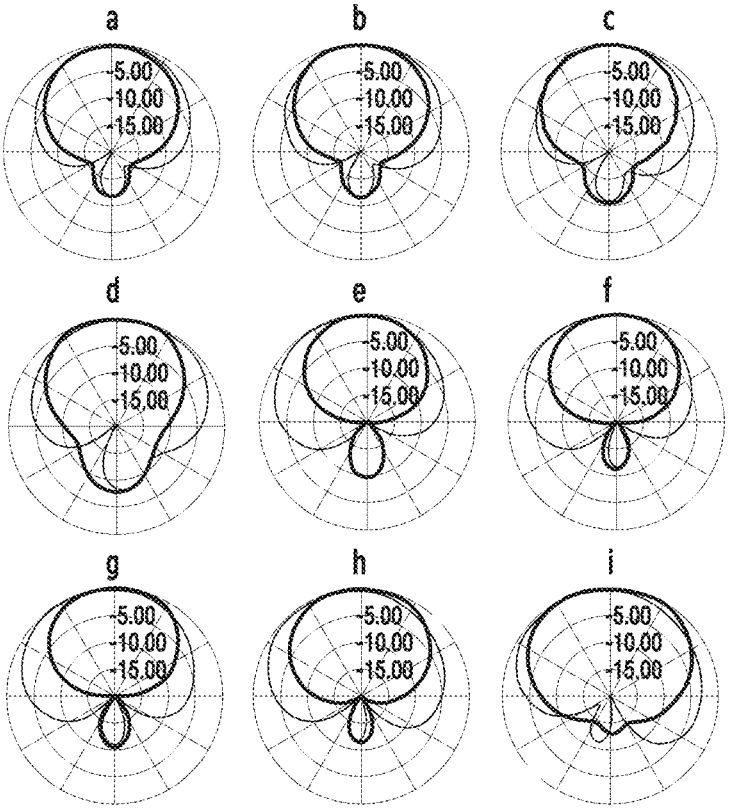

Referring to FIG. 7, the $TE_{101}$ mode having the Q-factor of 3.8 occurs at 260 GHz, and the $TE_{111}$ mode having the Q-factor of 20.0 occurs at 320 GHz. A $TE_{201}$ mode having the Q-factor of 8.6 occurs at 362 GHz, and a $TE_{211}$ mode occurs at about 362 GHz. In addition, a $TE_{011}$ mode having the Q-factor of 8.3 occurs at 387 GHz, and the $TE_{111}$ mode having the Q-factor of 9.1 occurs at 397 GHz. Since no other modes than the $TE_{101}$ mode occur near 300 GHz as shown in FIGS. 8A and 8B, the antenna of FIG. 7 can serve as a single-resonance antenna at about 300 GHz. At this time, the radiation pattern for the frequency band is shown in FIGS. 8 A and 8B.

FIGS. 8A and 8B depict radiation patterns of an antenna apparatus having a single resonance characteristic according to various embodiments of the present disclosure.

Referring to FIG. 8A, a reflection coefficient S(1, 1) based on the frequency change, and FIG. 8B shows radiation patterns corresponding to nine frequencies of FIG. 8A. As shown in FIGS. 8A and 8B, the single resonance design has a relatively narrow operating bandwidth but exhibits a relatively constant radiation pattern which does not change according to the frequency.

Figure 9:
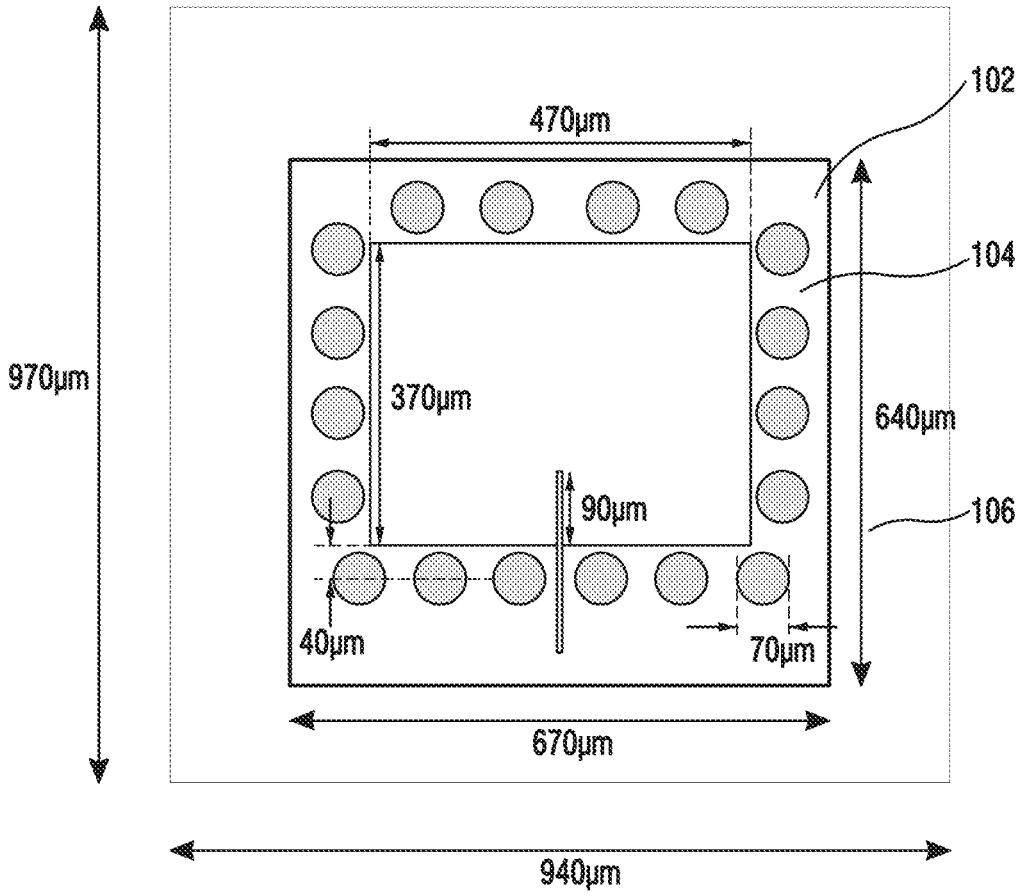
FIG. 9 depicts a design of an antenna apparatus having a multiple-resonance characteristic according to an embodiment of the present disclosure.

FIGS. 9, 10, 11A, and 11B illustrate designs and characteristics of an antenna which produces multiple-resonance according to various embodiments of the present disclosure. FIG. 9 depicts a design of an antenna apparatus having a multiple-resonance characteristic according to an embodiment of the present disclosure.

Referring to FIG. 9, the first conductor plate 102 is 670×640 μm and the aperture in the first conductor plate 102 is 470×370 μm in size. For example, a ratio of the height and the width of the aperture is about 1:1. For example, a difference of the height and the width of the aperture can be designed below 100 μm. For example, the rate of the width to the height in the aperture can be 1 through 1.3. Although not depicted in FIG. 9, the width of the aperture can be designed to be much greater than the cavity depth. The diameter of the via set 104 is 70 μm, and the distance from the boundary of the aperture to the center of the via set 104 is 40 μm. The feed line protrudes 90 μm toward the aperture. At this time, the resonant frequency is shown in FIG. 10.

Figure 10:
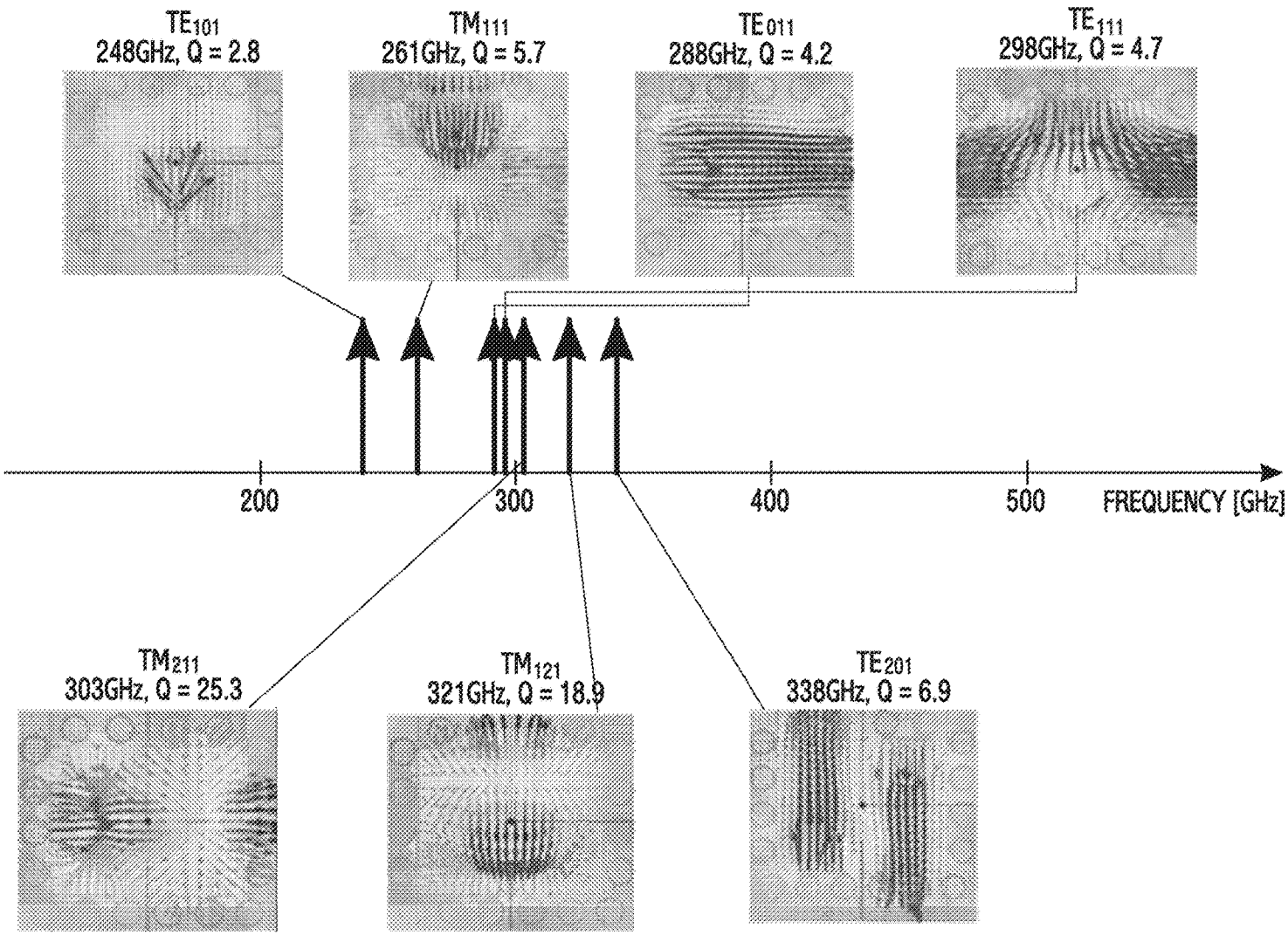
FIG. 10 depicts resonant frequencies of an antenna apparatus having a multiple-resonance characteristic according to an embodiment of the present disclosure.

FIG. 10 depicts resonant frequencies of an antenna apparatus having a multiple-resonance characteristic according to an embodiment of the present disclosure.

Referring to FIG. 10, the $TE_{101}$ mode having the Q-factor of 2.8 occurs at 248 GHz, and the $TE_{111}$ mode having the Q-factor of 5.7 occurs at 261 GHz. The $TE_{011}$ mode having the Q-factor of 4.2 occurs at 288 GHz, and the $TE_{111}$ mode having the Q-factor of 4.7 occurs at about 298 GHz. In addition, the $TE_{211}$ mode having the Q-factor of 25.3 occurs at 303 GHz, the $TE_{121}$ mode having the Q-factor of 18.9 occurs at 321 GHz, and the $TE_{201}$ mode having the Q-factor of 6.9 occurs at 338 GHz. As shown in FIG. 10, about five resonance modes occur near 300 GHz. For example, by increasing the height of the aperture to 370 μm, up to five resonances can occur near 300 GHz. Hence, the antenna apparatus of FIG. 9 can serve as the multiple-resonance antenna at the frequency 300 GHz. At this time, the radiation pattern for the frequency band is shown in FIGS. 11A and 11B.

Figure 11A:
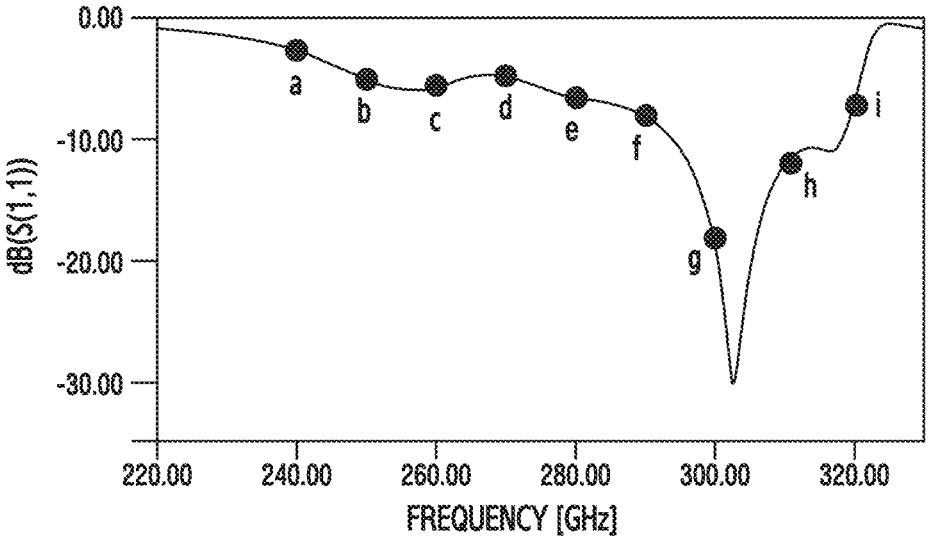
FIGS. 11A and 11B depict radiation patterns of an antenna apparatus having a multiple-resonance characteristic according to various embodiments of the present disclosure.
Figure 11B:
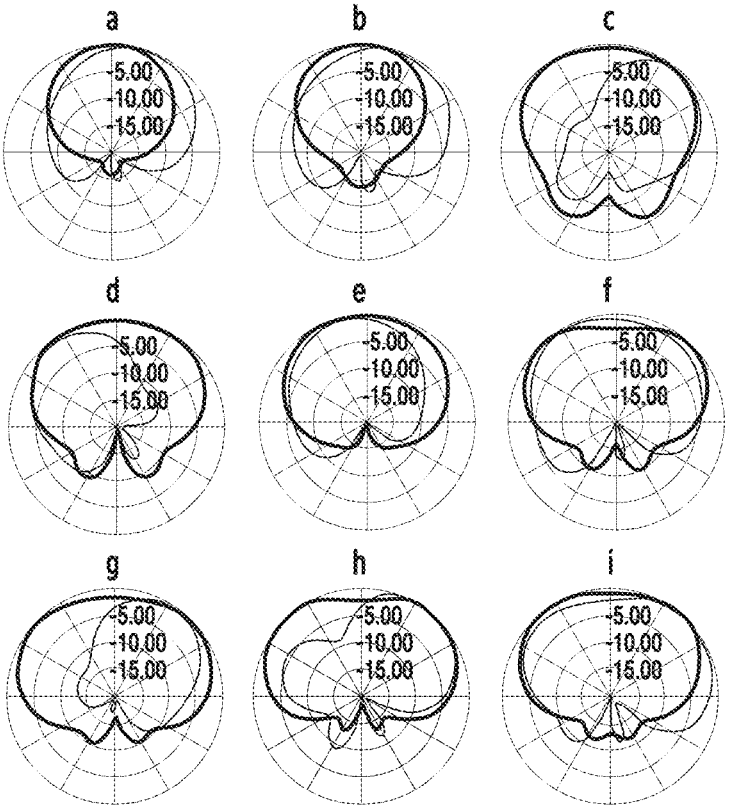

FIGS. 11A and 11B depict radiation patterns of an antenna apparatus having a multiple-resonance characteristic according to various embodiments of the present disclosure.

FIG. 11A shows the reflection coefficient S(1, 1) based on the frequency change, and FIG. 11B shows radiation patterns corresponding to nine frequencies of FIG. 11A.

Referring to FIG. 11A, multiple resonances occur in combination and thus the bandwidth is considerably improved. However, referring to FIG. 11B, the radiation pattern can be skewed according to the frequency. Using short-range communication, the antenna apparatus according to various embodiments can be used as an antenna structure for a broadband communication system in spite of the skewed radiation pattern. For example, the short-range communication includes communication between chips in the device.

The radiation pattern characteristic based on the frequency as shown in FIGS. 11A and 11B can unintentionally form the radiation pattern determined by the multiple resonance modes. The radiation pattern can be controlled deliberately by suppressing some resonance modes. The resonance mode can be restrained by controlling a shape of a feeding circuit, such as feed line or by applying additional metal patterning. For example, when a vertical monopole feed is used, the $TE_{011}$ mode and the $TE_{201}$ mode have the field distribution orthogonal to the feed in FIG. 10 and thus the $TE_{011}$ mode and the $TE_{201}$ mode can be restrained.

The aperture of the cavity of the antenna apparatus according to various embodiments has been explained in the quadrangular shape. According to other embodiments of the present disclosure, the aperture can be designed in various shapes. Examples of the cavity designed in other shapes are shown in FIGS. 12A and 12B.

Figure 12B:
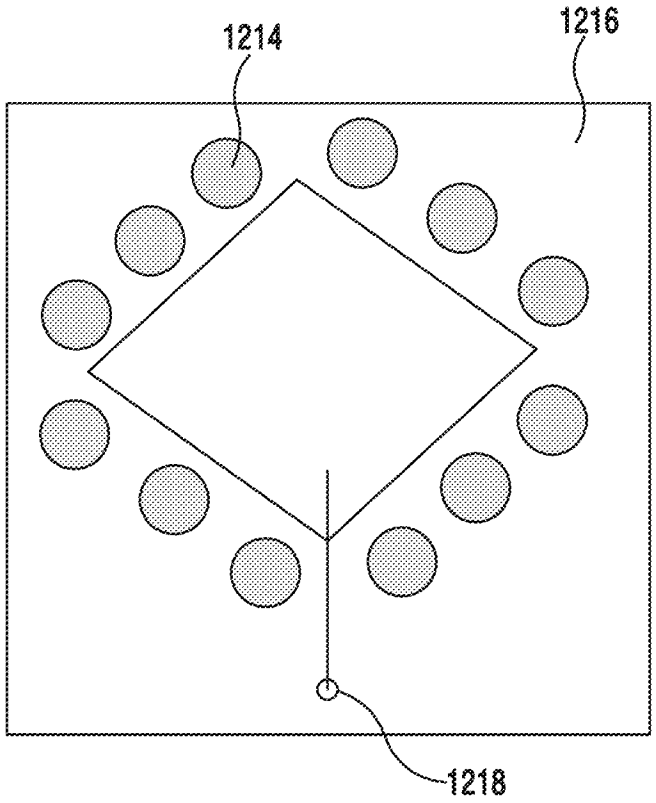
FIGS. 12A and 12B depict modifications of an aperture of an antenna apparatus according to various embodiments of the present disclosure.
Figure 12A:
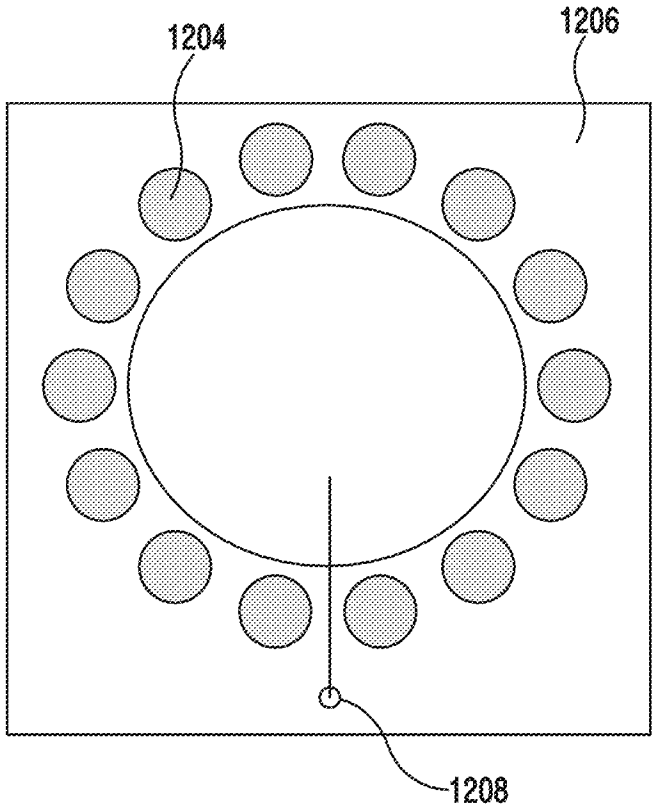

FIGS. 12A and 12B depict modifications of an aperture of an antenna apparatus according to various embodiments of the present disclosure. FIG. 12A illustrates a circular aperture and FIG. 12B shows a rhombus aperture.

Referring to FIG. 12A, vias 1204 are inserted into a substrate 1206 and arranged along edges of the circular aperture. A feed line 1208 protrudes inward into the circular aperture. Referring to FIG. 12B, vias 1214 are inserted into a substrate 1216 and arranged along edges of the rhombus aperture. A feed line 1218 protrudes inward into the rhombus aperture. While the circular and rhombus apertures are shown in FIGS. 12A and 12B, the aperture can be designed in different shapes (e.g., polygon) according to various embodiments of the present disclosure.

As the shape of the aperture is modified as shown in FIGS. 12A and 12B, the radiation pattern formed in each resonance mode can change. Hence, the shape of the aperture can be appropriately designed to achieve an effective radiation pattern according to a structure of a module or a device including the antenna apparatus, a signal frequency band, or a location relation with other communicating module or device.

According to various embodiments of the present disclosure, a space inside the cavity is filled with the substrate, that is, the dielectric. Notably, it is possible to stuff the inner space with the air or other dielectric. Modifications of the inner space of the cavity are shown in FIGS. 13A and 13B.

Figure 13A:
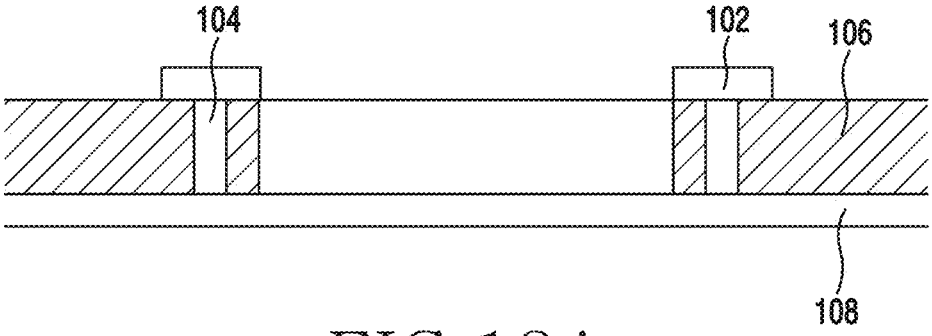
FIGS. 13A and 13B depict modifications of an inner structure of an antenna apparatus according to various embodiments of the present disclosure.
Figure 13B:
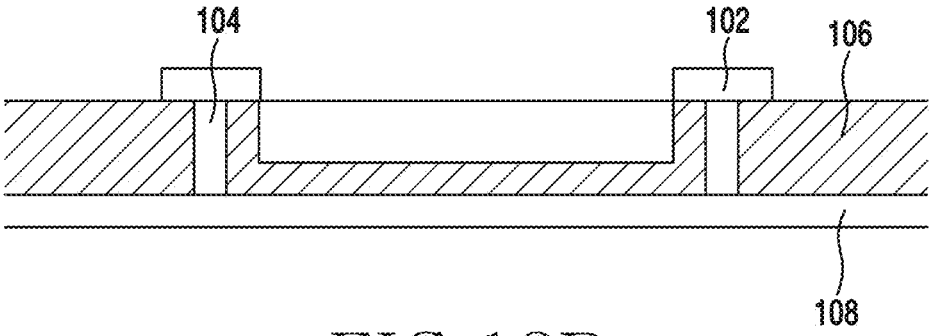

FIGS. 13A and 13B depict modifications of an inner structure of an antenna apparatus according to various embodiments of the present disclosure.

Referring to FIG. 13A, a cross-sectional view of the antenna apparatus is illustrated. The entire inner space is filled with the air in FIG. 13A and only part of the inner space is filled with the air in FIG. 13B.

Referring to FIG. 13B, the inner space is filled with the air to the same depth from every position. According to various embodiments of the present disclosure, the depth of the filling air can differ according to the location in the inner space. Accordingly, a boundary between the space filled with the air and the space filled with the dielectric can have other shape (e.g., a curve line, a broken line, and the like) than a straight line. While the inner space is hollow, that is, filled with the air in FIGS. 13A and 13B, the hollow space can be replaced by a material having a different permittivity from the second conductor plate 108.

As set forth above, the system on chip (SOC) antenna structure can exhibit high efficiency and broadband characteristics.

In the specific embodiments of the present disclosure, the elements included in the present disclosure are expressed in a singular or plural form according to the suggested specific embodiment of the present disclosure. However, the singular or plural expression is appropriately selected according to a proposed situation for the convenience of explanation and the present disclosure is not limited to a single element or a plurality of elements. The elements expressed in the plural form may be configured as a single element and the elements expressed in the singular form may be configured as a plurality of elements.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An apparatus of an antenna comprising:

a first conductor plate disposed in a groove of an upper side of a single substrate and comprising an aperture;

a plurality of vias inserted to vertically penetrate through the single substrate;

a second conductor plate disposed on a lower side of the single substrate; and a feed line for applying a signal to radiate to a dielectric resonator embedded as a cavity which is formed by the first conductor plate, the second conductor plate, and the plurality of vias, wherein the aperture has a height and a width which produces multiple-resonances at an operating frequency, wherein the width of the aperture is greater than a depth of the cavity, wherein the depth of the cavity differs according to a thickness of the single substrate, wherein the single substrate is a multi-layered substrate, wherein the first conductor plate, the plurality of vias, and the second conductor plate are assembled on the single substrate through a semiconductor manufacturing process, wherein a part of an inside of the cavity is filled with air, and another part of the inside of the cavity is filled with a material having a different permittivity than the second conductor plate, and wherein a boundary between the part and the another part forms a curved line or a polygonal line.

2. The apparatus of claim 1, wherein the plurality of vias are arranged along edges of the aperture.

3. The apparatus of claim 1, wherein the aperture comprises a quadrangular shape, and wherein a ratio of the width and the height of the aperture is 1 through 1.3.

4. The apparatus of claim 1, wherein the plurality of vias build a fence to form the cavity.

5. The apparatus of claim 1, wherein a shape of the aperture comprises any one of a quadrangle, a circle, a rhombus, a triangle, or a polygon.

6. The apparatus of claim 1, wherein the feed line is disposed between inner layers of the single substrate or on the first conductor plate.

7. The apparatus of claim 1, wherein a thickness of the single substrate exceeds 70 μm.

8. The apparatus of claim 1, wherein the single substrate comprises a plurality of inner layers to form at least one metal patterning.

9. The apparatus of claim 1, wherein the plurality of vias are arranged at intervals.

10. The apparatus of claim 1, wherein a shape of each of the plurality of vias comprises one of a cylindrical shape or a polygonal shape.

11. The apparatus of claim 6, wherein the feed line is disposed between inner layers of the single substrate.

12. The apparatus of claim 6, wherein the feed line is disposed on the first conductor plate.

13. The apparatus of claim 1, wherein the height of the aperture is the same as the width of the aperture.

14. The apparatus of claim 1, wherein each of the plurality of vias is a conductor.

15. The apparatus of claim 1, wherein the cavity is formed without metal patterning.

* * * * *